US005712456A

United States Patent [19]

McCarthy et al.

[11] Patent Number: 5,712,456

[45] Date of Patent: Jan. 27, 1998

[54] FLYWHEEL ENERGY STORAGE FOR OPERATING ELEVATORS

[75] Inventors: Richard C. McCarthy, Simsbury; Joseph Bittar, Avon, both of Conn.

[73] Assignee: Otis Elevator Company, Farmington, Conn.

[21] Appl. No.: 632,377

[22] Filed: Apr. 10, 1996

[51] Int. Cl.[6] ..... B66B 1/06

[52] U.S. Cl. ..... 187/290; 187/289; 322/4

[58] Field of Search ..... 187/290, 289, 187/277, 296, 297; 322/4

[56] References Cited

U.S. PATENT DOCUMENTS

| | | | |
|---|---|---|---|
| Re. 32,404 | 4/1987 | Ferris | 187/100 |
| 3,469,657 | 9/1969 | Sgroi | 187/29 |
| 4,657,117 | 4/1987 | Lauer | 187/114 |
| 4,787,021 | 11/1988 | Hokari et al. | 363/37 |

FOREIGN PATENT DOCUMENTS

| | | | |
|---|---|---|---|
| 5-221590 | 8/1993 | Japan | 187/290 |
| 61-285097 | 12/1996 | Japan | 187/290 |

OTHER PUBLICATIONS

J.P. Barthelemy, Conference: Intelec 81, Third International Telecommunications Energy Conference, London England May, 19–21 1981.

P.A. Studer and H. E. Evans, Conference Proceedings of the 16th Intersociety Energy Conversion Engineering Conference. Technologies for the transition. Atlanta GA, Aug. 9–14 1981.

*Primary Examiner*—Robert Nappi

[57] ABSTRACT

An elevator system, having a three phase rectifier (20) which converts energy from a three phase AC main (21) to provide DC power on a bus (19) to a three phase inverter (18) that drives a three phase inductive hoist motor (17), utilizes regenerated energy applied (46, 47) to a boost regulator (52) to drive (54, 55) a flywheel motor generator (26) to store the regenerated energy in the form of inertia therein. When the flywheel motor generator reaches a limiting speed, any continued regenerated energy is dumped (59, 60) in an energy dissipating device (61). During periods of high demand, the inertial energy stored in the flywheel motor generator is utilized (67, 68) to add energy to the DC bus to provide additional current to the three phase inverter for driving the hoist motor. The control is provided by software embedded in an elevator computer (such as used for dispatching and motion control).

9 Claims, 4 Drawing Sheets

FLYWHEEL ENERGY STORAGE FOR OPERATING ELEVATORS

TECHNICAL FIELD

This invention relates to the use of a flywheel motor/generator to store regenerated electrical energy developed by an elevator for use in assisting operation of the elevator during heavy power demand.

BACKGROUND ART

The power demands for operating elevators range from highly positive, in which externally generated power is used at a maximal rate, to negative, in which the load in the elevator drives the motor so it produces electricity as a generator, which is referred to herein as regeneration. On average, if all the passengers who rise up through a building on an elevator also return down through the building on the same elevator, the average power required to run the system would be zero, but for frictional losses. In fact, there is a significant amount of energy generated by the system which currently is dissipated as waste heat in the machine room of an elevator. This is not only wasteful of the generated electricity, but in turn adds more waste in the requirement for air conditioning to keep excessive heating from occurring.

Elevator systems of the prior art have utilized batteries to capture the energy generated by an elevator during regenerative operation. However, batteries present safety concerns in the building, and have an impact on the environment. Battery systems are therefore costly to initiate and costly to maintain.

In U.S. Pat. No. 4,657,117, the electric motor which drives a Ward-Leonard type of generator/motor system is mechanically connected through a start up clutch and an override clutch to a bevel gear assembly, the output of which drives the generator of the Ward-Leonard system. The bevel gear assembly is also mechanically connected to a flywheel. However, the flywheel must operate at a wide variety of speeds as a function of the wide variations in inertial energy stored therein. But the Ward-Leonard generator is driven by a synchronous motor at a fixed RPM. In addition, the conversion of regenerative mechanical energy to electrical energy through the hoist motor, thence to mechanical energy in the Ward-Leonard generator, and thence to inertial energy in the flywheel requires a different set of parameters than when the flywheel is assisting in driving the Ward-Leonard generator. Furthermore, there is no way to control the maximum flywheel speed or to dissipate the excess energy when the flywheel meets its maximum speed.

DISCLOSURE OF INVENTION

Objects of the invention are to provide an improved utilization of flywheel energy storage to assist in satisfying maximum power requirements in an elevator drive system.

According to the present invention, a flywheel motor generator, that is, a motor generator having very high inertia, is electrically connected to an elevator drive system through a current controller that allows building power to store inertial energy in the flywheel motor generator when the elevator is braked, that allows energy in the flywheel motor generator to be utilized to assist building power in operating the hoist motor during periods of high power demand, and to store in the flywheel motor/generator electric energy created when the elevator is driving the hoist motor in a regenerative fashion. According to the invention in one form, an elevator hoist motor comprises an induction motor driven by a three phase inverter, which is in turn fed DC power from a three phase rectifier responding to an AC power main; electric energy is added to or removed from the DC bus depending upon the operating mode, as described briefly above. In accordance with the invention still further, electric energy generated by the flywheel motor generator may be added to the DC bus as needed by pulse width modulation. In accordance still further with the invention, electrical energy generated by the hoist motor when operating regeneratively may be converted to a higher voltage with a boost regulator, thereby accommodating the disparity in the physical parameters of a driving system from that of a regenerating system.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
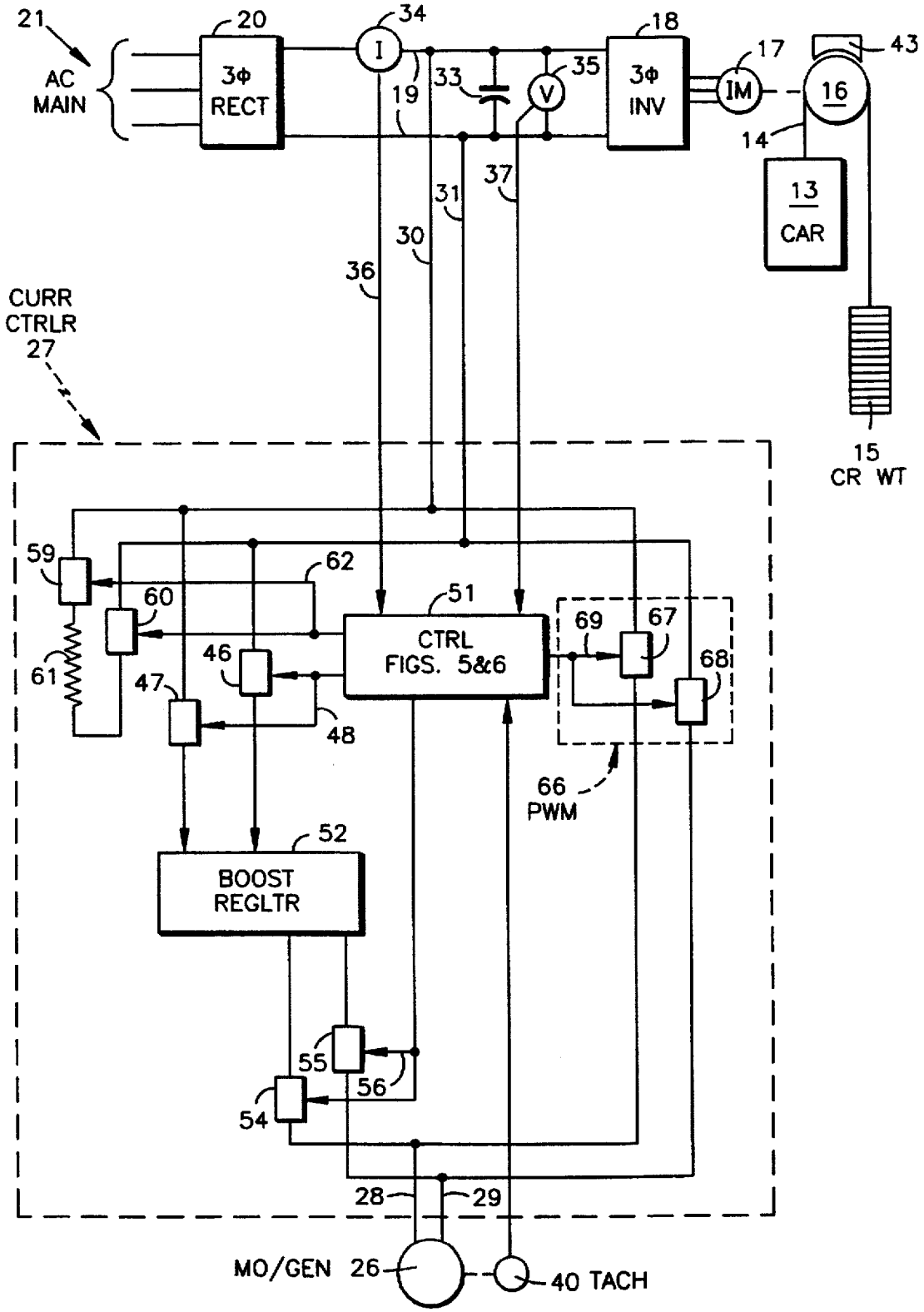
FIG. 1 is a somewhat stylized, schematic block diagram of an elevator system incorporating the present invention.

Referring now to FIG. 1, an elevator car 13 is hoisted by a roping system including a rope 14, a counterweight 15 and a sheave 16 which is driven by a three phase induction motor 17. The motor 17 is driven by a three phase inverter 18 in response to DC power provided on a DC bus 19 by a three phase rectifier 20 which responds to three phase power from an AC main 21. The apparatus described thus far is conventional, and in a conventional elevator system not employing the present invention, the three phase rectifier 20 and the AC mains 21 would be sized sufficiently so as to provide all of the power necessary for the three phase inverter 18 to drive the induction motor 17 under all conditions of operation. When the elevator is being accelerated, or when it is being run up with a heavy load, or when it is being run down with a light load, a maximal amount of power is required. When the elevator is leveling or running at a fixed speed with a balanced load, it may be utilizing a lesser amount of power. When the elevator is being decelerated, running down with a heavy load, or running up with a light load, the elevator actually drives the motor 17 causing power generation which passes through the three phase inverter 18 back to the DC bus 19. In the prior art, means are provided (not shown herein) to dissipate the energy generated during regeneration in the machine room, simply as waste heat. As described hereinbefore, not only is this wasteful, but it also requires the use of more energy for air conditioning.

In accordance with the present invention, a flywheel motor generator (defined herein as a motor/generator having extremely high inertia) 26 is connected to the DC bus through a current controller 27 by conductors 28–31. The DC bus 19 is provided with a very large capacitor 33 to smooth the DC voltage and to store pulses of energy provided to the bus 19 by the current controller 27, as is described hereinafter. The current being provided by the three phase rectifier 20 is monitored by a current sensor 34 and the voltage across the bus is monitored by a voltage sensor 35 which are connected to the controller by lines 36, 37, respectively. The flywheel motor/generator 26 is mechanically connected to a tachometer 40 which provides speed information on a line 41 to the current controller 27.

Figure 2:
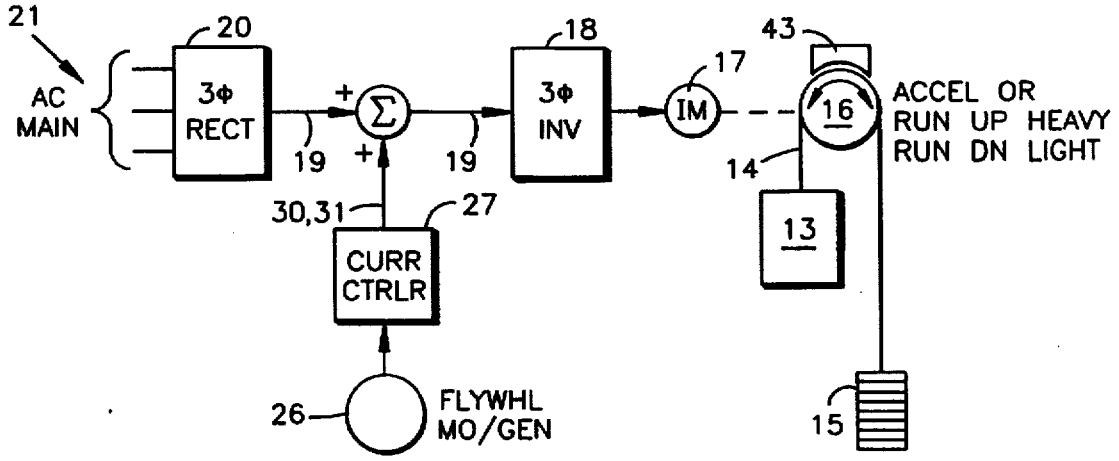
FIG. 2 is a simplified version of FIG. 1, when operating in the drive mode.
Figure 3:
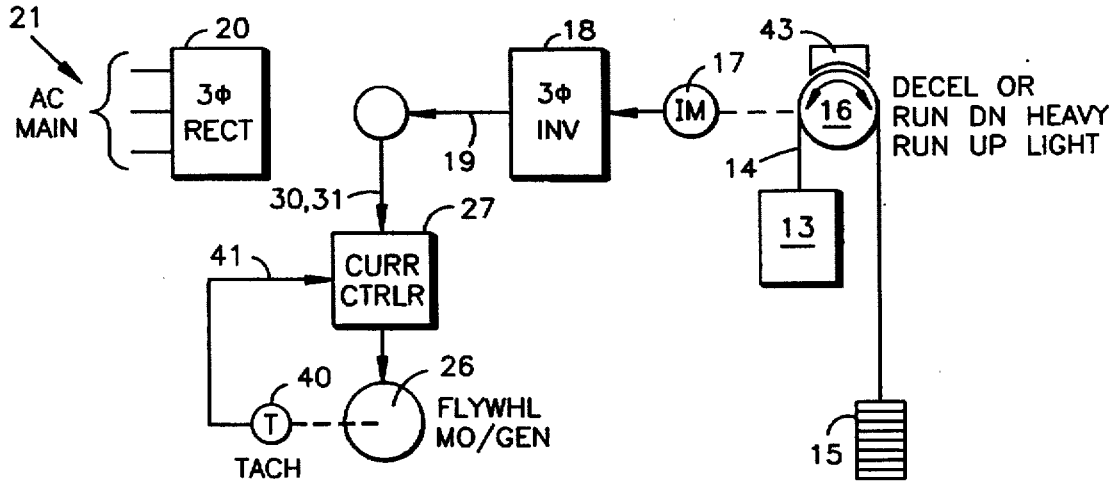
FIG. 3 is a simplified version of FIG. 1 when operating in a regenerative mode.
Figure 4:
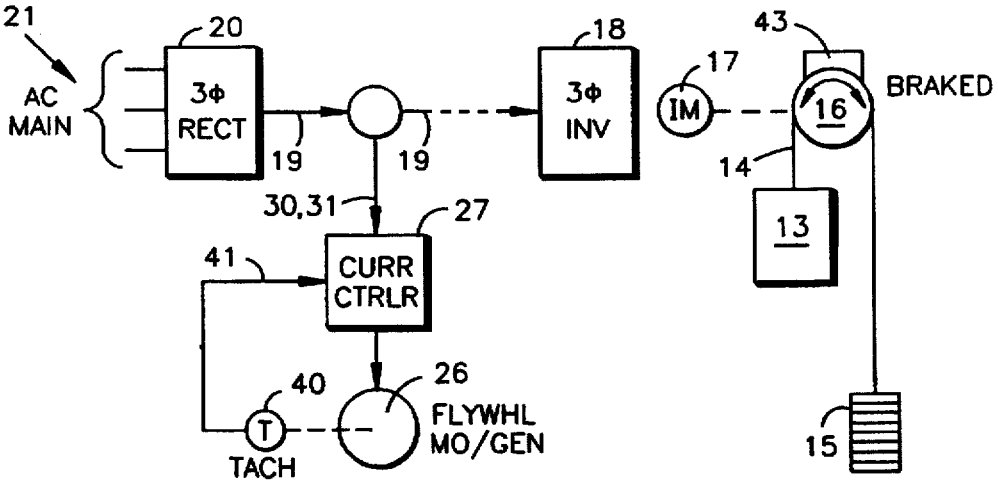
FIG. 4 is a simplified version of FIG. 1 when operating in a braked mode.

The operation of the invention is described briefly with respect to FIGS. 2–4. In FIG. 2, the system is in what is referred to herein as a drive mode, in which a large amount of power is required to either accelerate the elevator, run a heavy elevator up, or run a light elevator down. By heavy is meant that the car is loaded so that it weighs more than the counterweight, and by light is meant that the car load is less than the counterweight, the counterweight typically being on the order of 40% of full or rated elevator load. In that circumstance, the three phase rectifier 20 is providing power to the DC bus 19, and the flywheel motor generator 26 is providing power through the current controller 27 and the lines 30, 31. Thus, the bus is acting as a current summing device to provide sufficient current to the three phase inverter so that the demand on the induction motor can be met.

In FIG. 3, a regenerative condition is defined as decelerating the elevator, running the elevator down when it is heavy, or running the elevator up when it is light. In that circumstance, the elevator actually drives the induction motor 17 which generates electric energy and passes it backward through the three phase inverter 18 to the DC bus 19. Instead of dissipating that energy as heat, the energy on the bus 19 is transferred over the lines 30, 31 through the current controller 27 to the flywheel motor generator 26. This causes the rotary speed of the flywheel motor generator to increase so long as the regenerative operation continues, up to the point where the tachometer 40 indicates that maximum speed of the flywheel motor generator is being approached. Then, the current controller 27 will transfer any further energy into a heat dissipator, as described more fully hereinafter.

In FIG. 4, when the elevator is not running, but the sheave is braked by virtue of a brake 43 not being lifted, three phase power from the AC main 21 is rectified in the three phase rectifier 20 and applied to bus 19. This in turn applies the DC power to the three phase inverter 18, but since it is being commanded to do nothing, no current is provided by the three phase inverter 18 to the induction motor 17. On the other hand, the DC power is applied over the lines 30, 31 to the current controller 27 which applies it suitably to rev up the flywheel motor/generator 26 in an initiation process. Thus, electric power is provided from the building directly to the flywheel motor/generator to initialize it at a high rotary rate, and to peak up its rotary speed toward maximum rotary speed each time that the elevator is braked. Of course, in a situation where the regenerative power of FIG. 3 has caused the flywheel motor generator to reach its maximum rate, little or no energy will be provided from the AC mains to the flywheel motor generator at the next stop.

Referring again to FIG. 1, the DC bus 19 is connected by lines 30 and 31 to a pair of switches 46, 47 that are turned on by a signal on a line 48 from a control 51 whenever the elevator is in the regeneration mode (FIG. 3). When turned on, the switches 46, 47 connect the lines 30, 31 to a boost regulator 52, the output of which is connected by a pair of switches 54, 55 to the leads 28, 29 that are connected to the flywheel motor/generator 26. The boost regulator utilizes switched inductance and capacitance to raise the voltage on the input of the switches 54 and 55 to a suitably high voltage that will allow the flywheel motor/generator 26 to reach the desired limiting speed. Switches 54, 55 will be turned on by a signal on a line 56 whenever the elevator is operating in a regenerative mode, so long as the motor/generator 26 does not reach a limiting speed. When the speed limit is reached, the switches 54, 55 are turned off. This prevents damage to the flywheel motor generator 26. The bus 19 is alternatively connected through a pair of switches 59, 60 to a conventional power dissipator 61 whenever the switches are turned on by a signal on a line 62 from the control 51; this occurs when the elevator is operating in a regenerative mode but the flywheel motor/generator 26 has reached its limiting speed. Thus, during regeneration, either the boost regulator 52 drives the flywheel motor/generator 26 or the bus dumps power into the dissipator 61.

On the other hand, when the elevator is not running, power on the bus 19 from the AC mains 21 is applied through the switches 46, 47 and 54, 55 until the flywheel motor/generator 26 reaches limiting speed. Thereafter, the switches 54, 55 are turned off so that no more power is consumed from the AC mains.

When operating in the drive mode (FIG. 2) the switches 46, 47, 54, 55, 59 and 60 are all turned off. The function of a pulse width modulator 66 is performed by a pair of switches 67, 68 in response to a signal on a line 69 from the control 51, which is limited in terms of pulse duration as a function of current required to be provided to the three phase inverter, in a manner described with respect to FIG. 6, hereinafter.

Figure 5:
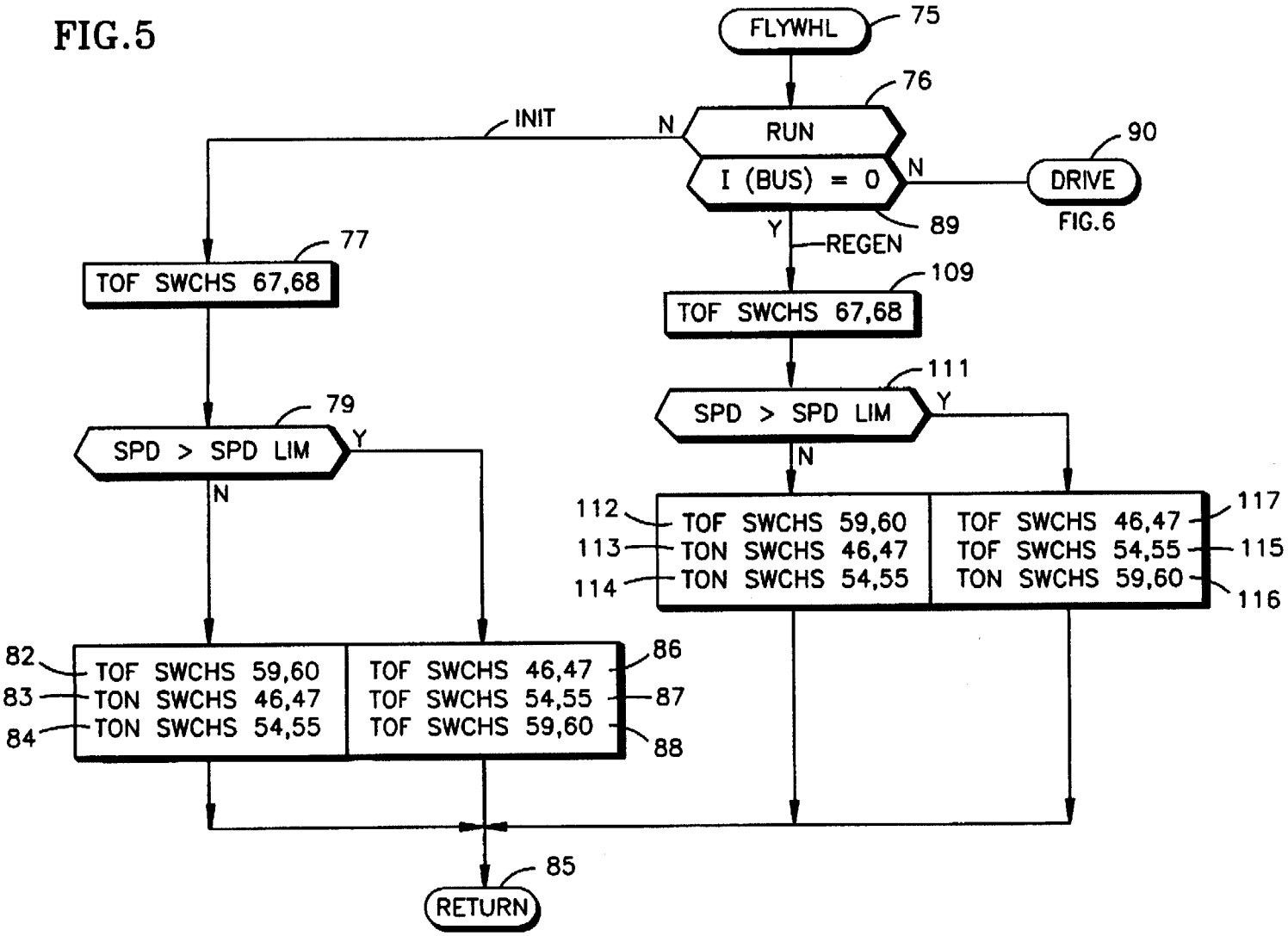
FIG. 5 is a simplified, logic flow diagram of a flywheel routine for use in the controller of the apparatus in FIG. 1.

The control 51 may be provided by software in a computer which may be a computer dedicated to the task, or may preferably be a computer which is also utilized for dispatching, motion control, and/or other functions of the elevator. In FIG. 5, a flywheel routine is reached through an entry point 75 and a first test 76 determines if the elevator is running or not. If not, the braked condition of FIG. 4 obtains. A negative result of test 76 reaches a step 77 to turn off switches 67 and 68, which connect the motor generator to the bus. Then a test 79 determines if the speed of the flywheel motor/generator equals or exceeds a speed limit established to avoid damage to it. If not, a step 83 will turn off switches 59 and 60 to isolate the dissipator 61, a step 83 will turn on switches 46 and 47 that connect the bus to the boost regulator, and a step 84 will turn on switches 54 and 55 so as to apply the high voltage output of the boost regulator 52 to the flywheel motor/generator 26 so as to accelerate it. Then other programming is reverted to through a return point 85. However, once the flywheel motor generator 26 reaches its limiting speed, in a subsequent pass through the routine of FIG. 5, an affirmative result of test 79 will reach a step 86 to turn off the switches 46 and 47, thereby to disconnect the boost regulator from the bust 19, a step 87 to turn off the switches 54 and 55, to disconnect the flywheel motor generator 26 from the output of the boost regulator 52, and a step 88 to turn ON the switches 59, 60 (redundantly). At this point, the three phase rectifier output goes nowhere so there is no power draw from the AC main 21. The routine of FIG. 5 may pass through a negative result of test 76 and an affirmative result of test 79 many times before the elevator is started.

Figure 6:
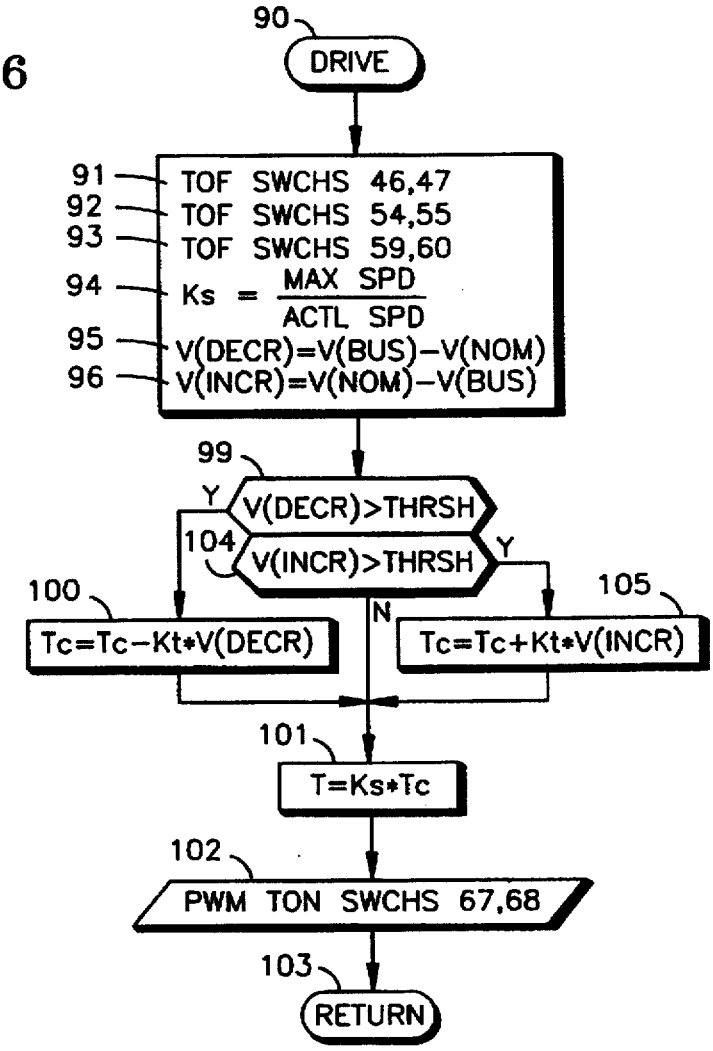
FIG. 6 is a simplified logic flow diagram of a drive subroutine for use in the routine of FIG. 5.
Figure 7:
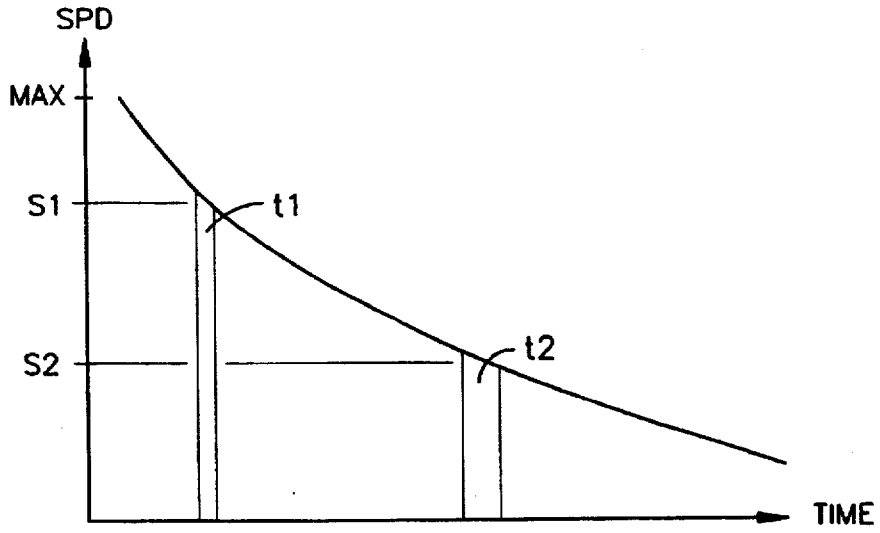
FIG. 7 is a diagram illustrating the relationship between flywheel motor/generator speed and energy.

Once the elevator is started, an affirmative result of test 76 reaches a test 89 to determine if current on the bus, as indicated on the line 36, is zero. When the elevator first starts up, it will be drawing current from the three phase regulator, so a negative result of test 89 reaches the drive routine of FIG. 6 through a transfer point 90. In FIG. 6, a first step 91 turns off switches 46 and 47, to disconnect the boost regulator 52 from the bus 19. A second step 92 turns off switches 54 and 55 to disconnect the flywheel motor/generator 26 from the boost regulator 52. A third step 93 turns off switches 59 and 60 to disconnect the dissipator from the bus 19. A fourth step 94 generates a gain factor, Ks, related to flywheel motor generator speed as a ratio of maximum speed to actual speed. The purpose for this, illustrated in FIG. 7, is to provide an equal quantum of energy. In FIG. 7, a given amount of energy can be derived at a high voltage which is available at high speed (such as S1) in a smaller time (such as duration t1) than the amount of time (such as duration t2) that would be required to derive the same amount of energy at a lower voltage which is available at a slower speed (such as S2). The gain factor, Ks, allows the conduction time for pulse width modulation to be adjusted as a function of speed, so that the corrected pulse width modulation will add about the same amount of energy to the bus at various speeds.

A pair of steps 95, 96 determine if the voltage of the bus 19 is deviating from the nominal voltage output of the three phase rectifier 20. When the induction motor 17 requires more power, the voltage on the bus 19 will drop; when the three phase rectifier can handle the load represented by the induction motor, then the nominal voltage will obtain. If the bus voltage is too high, the factor derived in step 95, V(DECR), will be positive indicating that the bus voltage is higher than the nominal voltage. But when the bus voltage is lower than the nominal voltage, indicating that the three phase rectifier 20 needs help in driving the induction motor 17, a voltage factor, V(INCR), will be generated, which if positive indicates that the bus voltage is lower than the nominal voltage. Then, a test 99 determines if in fact the bus voltage is higher than nominal, by some threshold amount; if it is, that means that the flywheel motor generator should provide less energy to the bus, so an affirmative result of test 99 will reach a step 100 to reduce the value of a pulse width modulation conduction time, Tc, which is carried along from one cycle to the next, by some constant, Kt, times the amount by which the bus voltage exceeds the nominal voltage, V(DECR). Then the value of the conduction time, Tc, is generated from the PWM conduction time of step 100 by means of the constant, Ks, of step 94, so as to adjust the pulse width modulation conduction time, T, in accordance with the speed and therefore the voltage of the flywheel motor generator, as described with respect to FIG. 7 hereinbefore. Once the pulse width modulation time, T, is generated, a subroutine 102 will provide pulse width modulated turn on of switches 67 and 68, to connect the output of the flywheel motor/generator 26 to the bus 19. The subroutine 102 will, on a periodic cyclic basis, turn on the switches 67, 68 for a fraction of the period, to reflect the pulse width modulation time, T, generated in step 101. The higher the demand by the induction motor 17, the larger the time, T, and the greater fraction of each period that the switches 67, 68 will be closed. The energy represented by current flowing at various voltage levels depending on speed from the flywheel motor generator 26 is basically dumped into the capacitor 33; and if the energy dumped in the capacitor 33 matches the current drain from the bus 19 by the three phase inverter 18 (which it should, based upon the functions 94–102 in FIG. 6), then the three phase inverter 18 will respond in the same fashion as if the three phase rectifier 20 were of suitable, conventional size. And then other programming is reached through the return point 103.

In the event that there is a high demand, in excess of the capacity of the three phase rectifier 20, then the indication thereof, V(INCR), generated in step 96 will be greater than a threshold value so that an affirmative result of a test 104 will reach a step 105 to generate the pulse width modulation conduction time, Tc, which is greater than the previous one by adding to it the factor Kt times the amount of difference between the nominal and bus voltage, V(INCR). And then this conduction time, which is suitable at the maximum speed, is adjusted upwardly by the constant Ks as described hereinbefore, and the resulting pulse width modulation conduction time, T, is utilized in the subroutine 102 to control the turn on time of the switches 67, 68. And then other programming is reached through the return point 103. The control represented by the drive subroutine of FIG. 6 is illustrated as a simple, linear control. However, feed forward, proportional gain, and other segments may be added in the control loop to provide a particular response characteristic, if desired.

Referring again to FIG. 5, in a pass through the flywheel routine, if the elevator is running, an affirmative result of test 76 reaches test 89; but if the elevator is operating in a regenerative mode, wherein the hoist motor 17 is generating electric power, current will tend to flow from the phase inverter 18 to the three phase rectifier 20. However, the three phase rectifier 20 will not accept current flow in the reverse direction. Therefore, the current through the current sensor 34 will be zero. In this circumstance, the test 89 recognizes regeneration by an affirmative result which reaches a step 109 to turn off switches 67 and 68, disconnecting the flywheel motor/generator 26 from the bus 19. A test 111 then determines whether the speed is greater than the limiting speed. If not, a step 112 will turn off switches 59 and 60, thereby to isolate the power dissipator 61, a step 11 will turn on switches 46 and 47, connecting the bus 19 to the boost regulator 52, and a step 114 will turn on switches 54, 55 to connect the output of the boost regulator 52 to the flywheel motor/generator 26. And then other programming is reached through the return point 85. In the operating mode depicted in FIGS. 5 and 6, once a switch is turned on or off by a particular step, it will remain that way until there is another step to countermand it. In many passes through steps 112–114, the switches will be redundantly turned off or on. Therefore, all of the regenerated power that reaches the bus 19 passes through the boost regulator and into the flywheel motor/generator 26, resulting in it accelerating, until such time as its limiting speed is reached. At that point, in a subsequent pass through the flywheel routine of FIG. 5, test 111 will be affirmative reaching a step 114 to turn off switches 46, 47 to isolate the boost regulator from the bus 19, a step 115 to turn off switches 54 and 55 thereby disconnecting the flywheel motor/generator 26 from the boost regulator 52, and a step 116 which turns on switches 59 and 60 thereby connecting the bus 19 to the power dissipator 61. Should there be a long period of regeneration with power dissipation, the flywheel motor/generator may lose some of its speed through frictional losses. Therefore, the test 111 could again become negative allowing the flywheel motor/generator to be accelerated again.

The current controller may be made more complex in order to recognize any situation where the three phase rectifier is driving the hoistmotor, but not at its full capacity. Then any excess capacity can be utilized to accelerate the flywheel motor generator, until it reaches maximum speed. This will help avoid dissipating all of the rotational inertia in the flywheel motor generator during up-peak operation in which heavy up runs are followed by light down runs so that no regeneration occurs over several runs. If the up-peak dissipation problem is very severe, a second three-phase inverter can be provided, perhaps with its own separate power feed, to be utilized only occasionally to accelerate the flywheel when there is insufficient regenerative operation or time at landings in which the flywheel motor generator can be accelerated.

The invention is shown as it is applied to a very common elevator drive system, in which a three phase rectifier provides DC power to a three phase inverter, the control of which controls the torque and speed of the induction motor. The invention may be practiced with other types of current controllers. The invention may be implemented in other elevator drive systems provided only that a flywheel motor generator is utilized to directly absorb electric energy during regeneration and provide, directly, additional electrical energy during periods of heavy demand. The invention utilizes the excess electrical energy generated by the induction motor directly to accelerate the flywheel motor generator, and provides electrical energy directly to the elevator drive system from the flywheel motor generator. This is the essence of the present invention.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An energy conserving, regenerative elevator system which derives principal electric power from an AC main, comprising:

a hoist motor;

a motor drive system for converting power in the AC main for providing power to said hoist motor;

a flywheel motor generator capable of storing an amount of energy as rotational inertia which is significant compared with the energy required for an elevator to accelerate and make a fully loaded up run;

and a current controller for utilizing electrical energy generated by said flywheel motor generator to assist in driving said hoist motor during periods of high power demand, and for utilizing electric energy generated by regenerative operation of said hoist motor to drive said flywheel motor/generator so as to increase its rotational inertia, thereby to store energy therein in the form of rotational inertia and to use that energy in the form of electricity generated by said flywheel motor/generator to assist in driving said hoist motor.

2. A regenerative system according to claim 1, further comprising:

an electric power dissipator; and wherein said current controller utilizes said electrical energy generated by said regenerative operation of said hoist motor to drive said flywheel motor/generator so as to increase its rotational inertia so long as said flywheel motor/generator does not exceed a rotary speed limit, and said current controller applies said electrical energy generated by said regenerative operation of said hoist motor to said electric power dissipator whenever said flywheel motor/generator reaches said rotary speed limit.

3. A regenerative system according to claim 1 wherein said flywheel motor/generator is a DC motor/generator.

4. A regenerative system according to claim 1 wherein said hoist motor is an induction motor.

5. A regenerative system according to claim 4 wherein said hoist motor is a three phase induction motor.

6. A regenerative system according to claim 4 wherein said motor drive system includes a rectifier responsive to AC power in said main to provide DC power on a bus and an AC inverter responsive to DC power on said bus to drive said hoist motor.

7. A regenerative system according to claim 1 wherein said current controller comprises transistor switches, the conduction of which is controlled by a computer responsive to electric operating parameters extant in said motor drive system.

8. An energy conserving, regenerative elevator system which derives principal electric power from an AC main, comprising:

a hoist motor;

a motor drive system for converting power in the AC main for providing power to said hoist motor;

a flywheel motor/generator capable of storing an amount of energy as rotational inertia which is sufficient to provide power on the order of the difference between the average power required by the elevator hoist motor and the peak power required during a heavy-power-demand run of the elevator;

and a current controller for utilizing electrical energy generated by said flywheel motor generator to assist in driving said hoist motor during periods of high power demand, and for utilizing electric energy generated by regenerative operation of said hoist motor to drive said flywheel motor/generator so as to increase its rotational inertia, thereby to store energy therein in the form of rotational inertia and to use that energy in the form of electricity generated by said flywheel motor/generator to assist in driving said hoist motor.

9. A method of operating an elevator system having a hoist motor, a motor drive system for converting power in an AC main to provide power to said hoist motor, and an electric power dissipator for dissipating electric energy generated by regenerative operation of said hoist motor; comprising:

utilizing electric energy generated by regenerative operation of said hoist motor to drive a flywheel motor/generator so as to increase its rotational inertia up to a limiting rotary speed, thereby to store energy therein in the form of rotational inertia;

utilizing electrical energy generated by said flywheel motor generator to provide additional power to said hoist motor during high-power-demand operation thereof; and applying power generated by regenerative operation of said hoist motor, whenever said flywheel motor-generator is rotating at said limiting rotary speed, to said electric power dissipator.

* * * * *